United States Patent [19]

Wilson

[11] Patent Number: 5,050,508

[45] Date of Patent: Sep. 24, 1991

[54] SYSTEM FOR THE INCINERATION OF REFUSE AND THE TREATMENT OF THE INCINERATION EXHAUST GASSES

[75] Inventor: Paul Wilson, Charleston Heights, S.C.

[73] Assignee: HCR, Hartsville, S.C.

[21] Appl. No.: 594,028

[22] Filed: Oct. 9, 1990

[51] Int. Cl.[5] ..... B09B 3/00

[52] U.S. Cl. ..... 110/235; 55/80; 55/404; 55/405; 55/267; 110/203; 110/211; 110/215; 110/216; 110/345; 110/346

[58] Field of Search ..... 110/203, 210, 211, 212, 110/215, 216, 345, 235, 346; 422/168; 55/80, 404, 405, 318, 320, 267

[56] References Cited

U.S. PATENT DOCUMENTS 4,402,738 9/1983 Akio ..... 110/212 X 4,571,175 2/1986 Bogle et al. ..... 110/215 X

*Primary Examiner*—Edward G. Favors

*Attorney, Agent, or Firm*—Richard C. Litman

[57] ABSTRACT

An improved system is provided for the incineration of refuse, especially scrapped automobile and truck tires and the treatment of incineration exhaust gasses as produced thereby. The refuse is incinerated in a closed fire box at controlled temperatures with the incineration exhaust gasses being serially treated by filtration, afterburning, washing with water by use of both a water bath and a water spray, washing with a petroleum based solvent, and cooling to a temperature below the freezing point of water. Filtration is carried out by a self-cleaning apparatus. A combined apparatus is used to carry out both the water bath and water spray with the resultant gasses being acceptable for release into the atmosphere.

18 Claims, 2 Drawing Sheets

SYSTEM FOR THE INCINERATION OF REFUSE AND THE TREATMENT OF THE INCINERATION EXHAUST GASSES

FIELD OF THE INVENTION

This invention relates to a method and apparatus for the incineration of refuse and the treatment of the incineration exhaust gasses.

BACKGROUND OF THE INVENTION

The invention provides an improved system for the incineration of refuse and the treatment of the incineration exhaust gasses.

The disposal of refuse by incineration is a well known process. In recent years, however, there has been increased concern about the atmospheric pollution caused by the exhaust gasses from such incineration. Today, any such incineration process is subject to rigorous state and Federal regulation.

Numerous attempts have been made to develop processes to incinerate refuse in compliance with government regulation. However prior methods have not been completely satisfactory from an economic standpoint and have not been designed to handle the incineration of certain types of refuse that pose special problems.

One type of refuse that presents a unique disposal problem is scrapped automobile and truck tires. Because of their negligible decomposition rate, scrapped tires take up an increased volume in landfills and such. Even when plowed under, the very nature of the resilient tires causes them to progressively migrate toward the surface. These tires pose unique health hazards as a tire's configuration is conducive to the pooling of stagnant water providing a breeding ground for insects and disease. Additionally, the fire hazard posed by such masses of scrapped tires is well known. Once a fire starts in such a mass of tires, the dense, acrid, and toxic smoke, and the intense heat make such a fire extremely difficult to extinguish. For the above reasons, as well as due to other health considerations, many jurisdictions are closing down landfills or at least forbidding the creation of new ones. Thus, it will be appreciated that considerate disposal means for scrapped tires now commands all the more attention, particularly in view of the several millions of such items as are discarded each year in this country alone.

Therefore, it would be advantageous to develop an economic refuse incineration and exhaust gas treatment method that will comply with all government standards and is also suitable for the disposal of scrapped tires.

DESCRIPTION OF THE RELATED ART

U.S. Pat. No. 3,745,939 discloses a method for treating exhaust gasses from the incineration of refuse especially automobile scrap including tires. Exhaust gasses from the incineration are subjected to an after burn, are then forced along a tortuous flow path, bubbled through a water bath, washed by a water spray and filtered prior to discharge to the atmosphere.

U.S. Pat. No. 4,704,972 discloses a method for treating the exhaust gasses from the incineration of wastes. The exhaust gasses are cooled to below their dew point before discharge.

U.S. Pat. No. 3,668,833 discloses a method for incinerating refuse especially automobile scrap including tires. The exhaust gasses are, in series, filtered, subjected to an after burn, and washed with water. Additionally, the exhaust gasses are passed through an electrostatic precipitator, and subjected to an alkaline water wash following the after burn, and subjected to a second filtration following the water wash.

None of the above known disclosures are seen as suggesting the unique combination as presented by the instant invention, which provides a thorough, efficient and clean disposal system.

SUMMARY OF THE INVENTION

By the present invention there is provided an improved method and apparatus of incinerating refuse, especially scrap tires, and of treating the exhaust gasses.

The refuse initially is incinerated in an enclosed chamber as provided by a fire box operated to provide a temperature of 2000 to 2500 degrees F., which is suitable to convert the combustible mass of the tires into vapor and gasses. The incineration exhaust gasses are then treated, in series, by cooling in a water-jacketed heat exhanger; passed through the first and second of three filtration stages; subjected to an after burn in a closed chamber at temperatures of 4000–6000 degrees F.; passed through a third filtration stage; passed through a combined water bath and spray water wash; passed through an oil bath; and finally, subjected to temperatures below the freezing point of water. The cleaned exhaust gasses are then discharged to the atmosphere.

Accordingly, one of the objects of the present invention is to provide an improved method for the incineration of refuse, especially scrapped tires, and for the treatment of the incineration exhaust gasses.

Another object of the invention is to provide a closed refuse incineration and exhaust gas treatment system that complies with known government standards.

Yet another object of the invention is to provide a refuse incineration and exhaust gas treatment system comprising in series a closed fire box for incineration, a cooling tank wherein the exhaust gasses from the fire box are cooled by heat exchange with water, a first filtration stage, a second filtration stage, an after burn, a third filtration stage, a water wash wherein the exhaust gasses are washed by a vapor-liquid contact process, an oil wash wherein the exhaust gasses are washed by a petroleum based liquid vapor-liquid contact process, and a freezing stage wherein the exhaust gasses are subjected to temperature below the freezing point of water before discharge of the exhaust gasses to the atmosphere.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
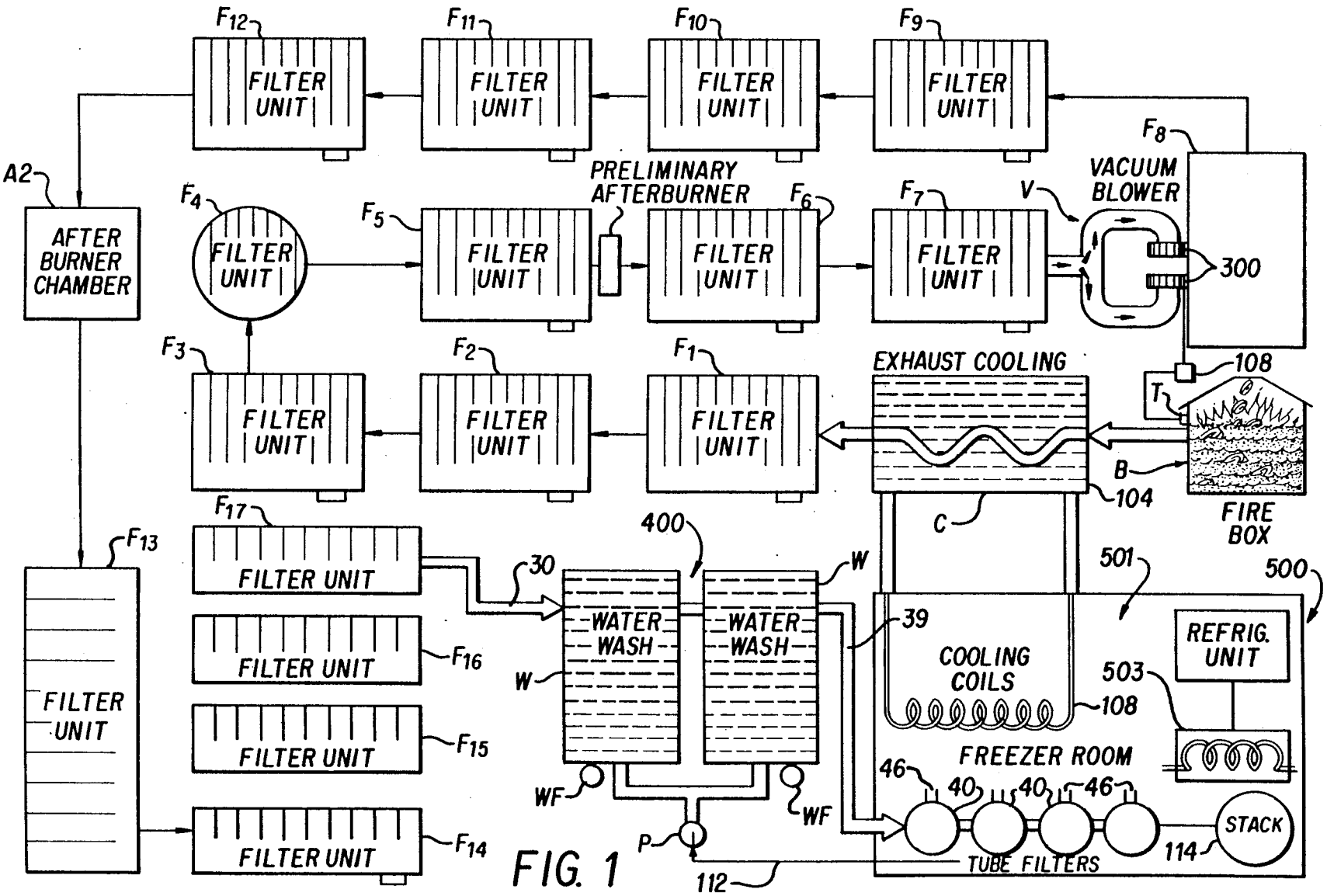
FIG. 1 is a diagrammatic flow chart illustrating the stages and sequences of operation of the components of the invention.
Figures 2, 3, 4:
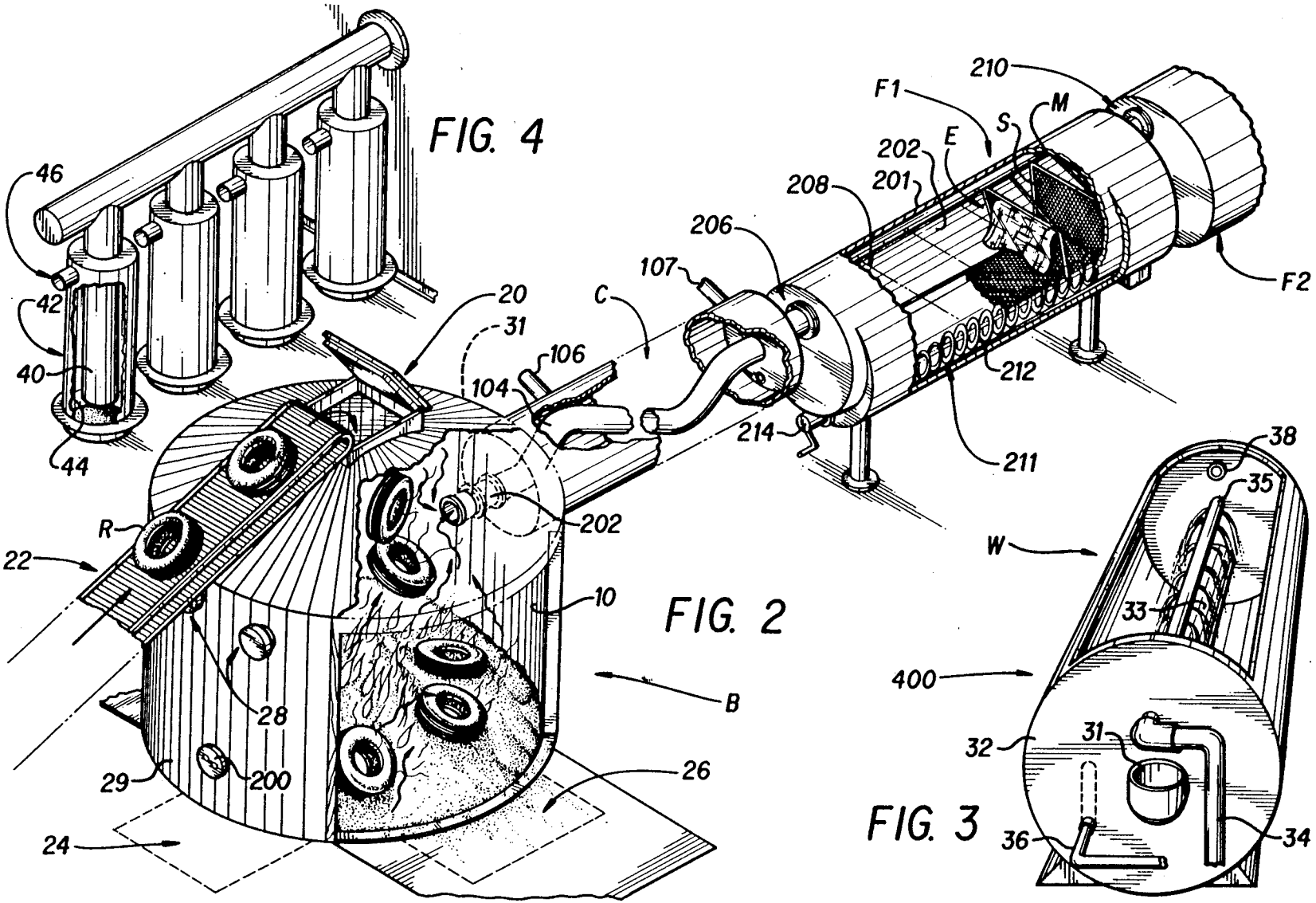
FIG. 2 is a fragmentary perspective view of the fire box, exhaust cooling unit, and the first filtration unit of the invention, with parts broken away for clarity.
FIG. 3 is a fragmentary perspective view of the combined water bath and water spray station.
FIG. 4 is a fragmentary perspective view of the tube filters of the invention.

Referring now to the drawings, particularly FIGS. 1 and 2, there is shown a circular incineration chamber 10 as defined by the fire box B. As shown in greatest detail in FIG. 2, the incineration fire box B has a closable, topmost access 20 through which refuse can be charged into the chamber 10, as by a conveyor 22. When the fire box B is charged, the access 20 is closed to provide a closed incineration chamber 10. An oil reservoir 24 at the bottom of and extending beneath the fire box B is allows oil decomposition products as formed from tire decomposition during the incineration process, to be accumulated. However, it has been found that at the incineration temperatures recommended for the preferred embodiment, namely 2000–2500 degrees F., oil accumulation will be negligible. Of course, if the economics of the process change, the amount of oil recovered can be increased by operating the fire box at lower incineration temperatures.

Also shown at the bottom of and extending beneath the fire box B is a scrap removal access 26 whereby solid scrap and ash from the incineration process can be periodically removed. The noncombustible scrap remaining after the incineration process includes steel fibers from reinforced tires. This solid scrap does not accumulate rapidly and can be removed on a batch basis.

Intake air for incineration enters through a plurality of inlet ports 28 in an outer wall area 29. Because of the negative pressure constantly induced in the fire box during incineration, no exhaust gasses can escape through these inlet ports 28, thus maintaining the integrity of the closed system. The inlet ports 28 can be equipped with adjustable restrictors (not shown) to control the volume of the intake air and therefore, the incineration temperature although, as will be seen, this is not the primary system control.

Multiple ignition means or torches 200 are located at selected fire box locations for initial ignition of the refuse R. Diesel fueled torches or the like may be used but in the preferred embodiment, readily commercially available oxy-acetylene fueled torches are utilized.

Incineration exhaust gasses pass from the fire box B through an off-take line 202 disposed through an inner wall area 31, opposed to the chamber outer wall area 29. The exhaust gasses then pass into an exhaust cooling unit C through the serpentine conduit 104 also shown in FIGS. 1 and 2. The cooling unit C includes a jacket 105 surrounding the conduit 104 and which is supplied with cooling water by way of an inlet 106 while the warmed water leaves by an outlet 107. In this manner, an exhaust gas/water heat exchanger is provided and which serves to provide the initial gas treatment means. By forcing the exhaust gasses to follow the tortuous path through the serpentine conduit 104, the cooling will be understood to be maximized. With the preferred incineration temperature maintained in the range of 2000° to 2500° F., the temperature observed at the exit 206 of the cooling chamber will be in the range of 150°F. to 200°F. The jacketing water in the cooling unit is constantly circulated as shown in FIGS. 1 and 2 and is passed through cooling coils 108 in an adjacent freezer room 500 to maintain the appropriate water temperature to achieve this gas temperature output at this station.

On exiting the exhaust cooling unit C at its outlet 206, the exhaust gasses pass into a first filter unit F1. The filter unit F1 includes a closed cylindrical tank 201 disposed horizontally and which includes an exhaust gas exit 210. Additional filter units as shown in the system are comprised of the same elements shown in detail for the filter unit F1 of FIG. 2. A plurality of baffles or abutment members 208 are provided at selected points within the unit interior 202, along the filter path to maximize turbulence in the exhaust gas flow stream therethrough. This discourages particulates and condensates within the exhaust gas stream from settling out at the tops and sides of the filter units which would increase system downtime by requiring shutdown for cleaning.

A plurality of filter supports S are pivotally mounted at varying heights in each filter unit. These are allowed a degree of freedom of motion, so as to permit their movement in the exhaust gas flow stream. Mechanical stops M limit the forward motion caused by the exhaust flow stream. Additionally, the filter supports S are constructed of a metallic material with a degree of magnetic polarity. By mounting the filter supports S in paired relationship with opposing magnetic polarity, the paired filter supports S tend to repel each other providing additional motion therebetween. The filter elements E themselves comprise flexible fabric sheets constructed of nylon mesh or the like and are weighted at the bottom. They are mounted on the filter supports S, covering the filter supports and extending below them to cover the internal cross section of the filter unit interior 202.

By allowing movement in the filter supports S and thereby the filter elements E, two desirable results are achieved: turbulence in the exhaust gas flow stream is maximized and the filter elements E become self-cleaning. As the filter members are buffeted by the gas stream flow, this constant vibratory motion causes entrained particulates as filtered from the exhaust stream to be dislodged from the filter elements E. As the dislodged particulates fall from the filter elements E, they collect in an axial channel 211 disposed along the center bottom of the filter unit tank 201. The accumulated particulates can be periodically removed by use of a rotating auger 212 activated from outside the filter unit by the handle 214. Upon actuation of the auger 212, the accumulated particulates are thereby forced out of the filter unit at the particulate discharge port 216. Depending upon the dictates of the system operation, the particulate removal process is conducted periodically.

In operation, therefore, incineration exhaust gasses entering the filter unit F1, for example, are forced in a tortuous flow path by the baffles 208, pass through the filter elements E where particulates are filtered out, and then exit at the filter unit outlet 210.

Although this filtration system was designed specifically for the method of the invention, it can be anticipated that the self-cleaning feature of the system will have other applications.

As stated earlier, each of the filtration units in the system, shown in FIG. 1 as F1 through F17, employs a combination of the baffles 208, filter supports S, and filter elements E as shown in FIG. 2 and discussed above. The only variation is that the filter elements E of successive units are made up of progressively finer mesh fabrics so that the filter elements E in filter unit F17 will entrain particulates of small nominal diameter than the filter elements E in filter unit F1 as shown in FIG. 2.

Refinement of the invention may include any alternate number of filter units, other than the number as shown. Quite obviously, variation of the mesh dimensions may be made, depending upon the nature of the volume or composition of refuse being treated. In the system as shown in FIG. 1, the first stage will be seen to comprise filter units F1 through F7 with unit F4 defining a vertically disposed filter unit inserted in series to change the exhaust gas flow pattern. These are all disposed downstream of the cooling unit C and upstream of a vacuum-blower V assembly designed to maintain a constant suction or partial vacuum leading back to the fire box B. The second stage comprises filter units F8 through F12 disposed downstream of the vacuum-blower V and upstream of an afterburner chamber A2. A third stage comprises the filter units F13 through F17 disposed downsteam of the afterburner chamber A2 and upstream of a water wash station 400. It is anticipated that the number of filter stages is also reducible.

After the first filter stage, filter units F1 through F7, the incineration exhaust gasses pass through the vacuum-blower V which may comprise a commercially available device with two internal paddle wheel fans 300 shown schematically in FIG. 1 and which creates a push-pull flow stream; that is exhaust gasses upstream of the vacuum-blower V are propelled through the system by the suction action of the vacuum-blower V and the exhaust gasses downstream thereof are propelled by the blowing action to the next filter stage. The fans 300 of the vacuum-blower V are disposed in the exhaust gas stream. For this reason, a preliminary afterburner A1 is included between filter units F5 and F6 primarily to further reduce particulate size in the exhaust gas stream prior to contact with the vacuum-blower fans 300 to reduce wear on the fan blades. The preliminary afterburner A1 is a closed unit through which the exhaust gasses are passed and therein subjected to preferably an oxy-acetylene torch operated at between 2000° and 2500°F.

In the preferred embodiment, the vacuum-blower V is used to control incineration temperature and temperature at various critical points in the system. The vacuum blower fans 300 are propelled by a variable speed electric motor. By varying the speed of the vacuum-blower V the exhaust gas flow rate is varied thereby varying the amount of intake air pulled into the incineration fire box B, through intake ports 28 as shown in FIG. 2. As the flow rate of intake air to the fire box B is increased, the incineration temperature is increased and the temperature of the exhaust gasses downstream of the fire box is also increased.

The speed of the vacuum blower is automatically controlled by suitable computer means shown at 108 in FIG. 1. The temperature in the fire box B, sensed at the temperature sensor T at the fire box, is input into the computer 108. The computer can also receive input from temperature sensors located at other selected critical points in the system and the vacuum-blower fan speed adjusted by a preset function. The higher the incineration temperature, as sensed at T, the more efficient the combustion process and the higher the refuse processing rate as long as the incineration temperature in the fire box B and the temperature of the exhaust gasses does not exceed the safety limits of the equipment. In the preferred embodiment, incineration temperatures in the fire box B are maintained between 2000° and 2500° F. This temperature may be increased as the construction methods and materials of the system equipment is upgraded.

Exiting the vacuum-blower V, the exhaust gases are forced through the second filter stage F8 through F12 and into the main afterburner chamber A2. This is a closed chamber with a fire brick lining and a commercially available oxy-acetylene torch. Flame temperature from the after burner torch is maintained in the range of 4000° to 6000° F.

The exhaust gasses are then forced through the third filtration stage as shown in FIG. 1, being sequentially directed through filter units F13 through F17, and thence into one of a pair of water wash tanks W defining a wash assembly 400.

The water wash assembly 400 consists of two horizontally mounted cylindrical tanks W,W operated in parallel. The representation in FIG. 1 will be understood to comprise a diagrammatic depiction while the specific construction of each tank W is shown in detail in FIG. 3. As exhaust gas is directed from the final filter unit F17 by conduit 30, these gasses enter through the end of either of the water wash tanks W by way of an inlet 31 in one end wall 32 and is directed through a perforated gas pipe 33 extending through the tank. Water level is maintained in the water wash tank W to just above the exhaust gas pipe 33 providing a water bath. Inlet water is pumped by a water pump P as shown in FIG. 1 through suitable water purification filters WF. Two water purification filters WF per water wash tank are mounted in parallel allowing one of the filters to be changed without necessitating system shutdown.

Returning to FIG. 3, water enters the tank W through a water inlet line 34 supplying water to a line continuing the length of tank W and forming an apertured spray line 35 disposed above the exhaust gas line 33.

The exhaust gas line 33 is perforated on its bottom side so that the exhaust gasses exit this line and bubble upward through the water bath in the tank. The spray line 35 is also perforated through it periphery so as to provide a water spray above the water bath. In this manner, the exhaust gasses will be subjected to both a water bath and a water spray. Water exits the water bath at a water outlet 36 disposed below the level of the water bath and is recirculated by pump P as shown in FIG. 1 which filters the water through the filters WF. Therefore, a constant recirculation of filtered water is maintained in the water wash system. When the water becomes too saturated with pollutants stripped from the exhaust gasses by the liquid-vapor contact process of the water wash assembly 400, the water is pumped to any suitable storage tank for appropriate disposal in accordance with approved procedure complying with all government discharge standards.

The exhaust gasses exiting the water wash assembly 400 from the respective outlets 38 are directed through conduit 39 which leads to a bank of vertically disposed tube filters 10 as shown in FIG. 1. The tube filters 10, shown in detail in FIG. 4, are commercially available units arranged in parallel. Each of the tube filters 10 consists of an inner exhaust gas inlet tube 40 and a closed outer casing 42. At the bottom 44 of each of the tube filters 10 is a layer of petroleum based solvent covering the end of the exhaust gas inlet tube 40. In the preferred embodiment, commercial engine lubricating oil is used. However, it is anticipated that other related petroleum based solvents will provide equal or better pollutant stripping capability.

The exhaust gasses enter through the exhaust inlet tube 40 and are forced downward to bubble through the petroleum based solvent at 44 where further pollutants are stripped from the exhaust gasses. The outer casing 42 of the tube filter has a narrow outlet 46 disposed at the top of outer jacket 42 which discharges into a freezer room 500. As the outlets 46 are narrow in diameter compared to the exhaust gas inlet tubes 40, back pressure is created within the tube filters increasing the solubility of pollutants in the petroleum based solvent therein.

On exiting the tube filters at 46, the exhaust gasses are released to the confines of the freezer room interior 501 as shown in FIG. 1. This freezer room 500 is an insulated chamber cooled by a commercial refrigeration unit 502 such as the Freon 502 system and includes exposed freezer coils 503.

Any temperature below the dew point of the exhaust gasses will cause condensate to form from the gas thus removing some of any remaining pollutants from the exhaust gasses. However, it has been found that pollutant removal is optimized if the freezing room temperature is at or below the freezing point of water, 32° F. Condensate is collected by standard collection means and routed to the water circulation system of the water wash system through the condensate line 112 by pump P.

In large part, the exhaust gas condensate will collect and freeze on the exposed freezer coils 503. The freezer unit 502 is cycled through a periodic defrost cycle to clear this frozen condensate. In the preferred embodiment, the freezer unit is preset to execute four defrost cycles per 24 hour period. The defrost cycle lasts approximately 10 minutes. As the frozen condensate on the freezer coils 503 is melted it enters the condensate collection system and is routed to the water wash system through condensate line 112.

The treated exhaust gasses within the freezer room interior 501 can now be discharged to the atmosphere through a conventional stack 114 disposed at the top of the freezer room.

Standard materials and methods of construction are used throughout the incineration and exhaust gas treatment system of the invention commensurate with the temperatures, pressures, and corrosiveness of the products involved. Equipment is sized depending on the desired volume of refuse to be processed. It will be understood that the system may also include auxiliary equipment such as additional storage tanks, auxiliary piping and pumping capacity, safety valves, and maintenance access for the various articles of equipment.

It is to be understood that the present invention is not limited to the sole embodiment described above, but encompasses any and all embodiments within the scope of the following claims.

I claim:

1. A method for the treatment of heated exhaust gasses from the incineration of refuse including the steps of;

directing said gasses through a plurality of filter units each containing a plurality of foraminous filter members to entrap particulate material present in said gasses, and subjecting said exhaust gasses after exiting said filter units to temperatures below that of the freezing point of water.

2. A method for the incineration of refuse and the treatment of incineration exhaust gasses comprising;

incinerating said refuse in a fire box having air intake means, oil decomposition product removal means, and exhaust gas off take means, directing said exhaust gasses from said off take means to cooling means, treating said exhaust gasses in said cooling means by heat exchange with a cooling liquid, passing said exhaust gasses through filtration means whereby particulates are removed from the exhaust gasses, subjecting said exhaust gasses to after-burning in a closed after-burner chamber, passing said exhaust gasses through a wash assembly whereby the exhaust gasses are passed through a water bath and subjected to a water spray, and discharging the cleaned exhaust gasses to the atmosphere.

3. The method of claim 2 further comprising cooling the exhaust gasses in a freezer room to a temperature below their dew point.

4. The method of claim 2 further comprising cooling the exhaust gasses in a freezer room to a temperature below the freezing point of water.

5. The method of claim 2 including;

directing said exhaust gasses through filter tubes having an oil wash disposed downstream of said wash assembly.

6. The method of claim 2 further comprising controlling the incineration temperature in said fire box by varying the speed of a vacuum blower disposed downstream of said fire box and upstream of said closed after-burner chamber.

7. The method of claim 6 further comprising subjecting the exhaust gasses to a preliminary after-burn in a preliminary after burner disposed downstream of the fire box and upstream of the vacuum blower.

8. The method of claim 6 wherein the vacuum blower further comprises automatic control means whereby the speed of said vacuum blower is varied in a functional relationship to the temperature sensed by temperature sensing means disposed at selected locations to include temperature sensing means disposed at the fire box.

9. The method of claim 6 further comprising maintaining the temperature in said fire box between 2000–2500 degrees F.

10. The method of claim 2 further comprising maintaining the temperature in said after-burner chamber between 4000–6000 degrees F.

11. An apparatus for incinerating refuse and treating exhaust gasses as generated thereby comprising;

a fire box defining an incineration chamber provided with ignition means, said fire box having air inlet and exhaust gas outlet means, exhaust gas cooling means adjacent said fire box and including an exhaust gas conduit therein communicating with said fire box outlet means, said conduit having discharging to an exit line, a plurality of filter units respectively joined in series and receiving exhaust gasses from said cooling means conduit exit line, said filter units provided with a plurality of foraminous filter members, a water wash assembly receiving exhaust gasses from said filter units, said assembly including a tank having a perforated exhaust gas pipe disposed within a circulating water bath, and cooling means receiving exhaust gasses discharged from said water wash assembly and operable to condense said exhaust gasses for collection of residual pollutants prior to discharge of said gasses to the atmosphere.

12. An apparatus for incincerating refuse and treating exhaust gasses according to claim 11 wherein, said fire box includes a peripheral wall of substantially circular configuration.

13. An apparatus for incinerating refuse and treating exhaust gasses according to claim 11 including, a vacuum-blower assembly and after-burner chamber disposed in series between individual ones of said plurality of filter units.

14. An apparatus for incinerating refuse and treating exhaust gasses according to claim 11 wherein, said exhaust gas cooling means includes a continuously circulating water bath surrounding said conduit and refrigeration means maintaining the water bath in a chilled condition.

15. An apparatus for incinerating refuse and treating exhaust gasses according to claim 11 wherein, said filter members within a single one said filter unit define apertures of progressively varying dimensions.

16. An apparatus for incinerating refuse and treating exhaust gasses according to claim 11 wherein, said filter members within successive ones of said filter units define apertures of progressively varying dimensions.

17. An apparatus for incinerating refuse and treating exhaust gasses according to claim 11 wherein, said filter units each include an elongated tank having a bottom most portion, and discharge means operable to remove particulates from said tank bottom most portion.

18. An apparatus for incinerating refuse and treating exhaust gasses according to claim 11 wherein, said filter units include exhaust gas inlet and outlet ports at opposite ends thereof, means movably mounting said filter members intermediate said filter unit ports, and said filter members shiftable upon impingement of said exhaust gasses thereupon whereby, particulates as entrapped by said filter members are encouraged to fall from said filter members.

* * * * *